US012604991B1

(12) United States Patent
Eastman

(10) Patent No.: US 12,604,991 B1
(45) Date of Patent: Apr. 21, 2026

(54) COLLAPSIBLE, SINGLE STEP STOOL

(71) Applicant: Nahpi Eastman, Colorado Springs, CO (US)

(72) Inventor: Nahpi Eastman, Colorado Springs, CO (US)

( * ) Notice: Subject to any disclaimer, the term of this patent is extended or adjusted under 35 U.S.C. 154(b) by 407 days.

(21) Appl. No.: 18/310,364

(22) Filed: May 1, 2023

Related U.S. Application Data

(60) Provisional application No. 63/337,732, filed on May 3, 2022.

(51) Int. Cl.

| | |
|---|---|
| ***A47C 12/00*** | (2006.01) |
| ***A47C 4/04*** | (2006.01) |
| ***A47C 9/10*** | (2006.01) |
| ***A47C 16/02*** | (2006.01) |
| *A47B 3/00* | (2006.01) |

(52) U.S. Cl.
CPC ..... *A47C 12/00* (2013.01); *A47C 4/04* (2013.01); *A47C 9/10* (2013.01); *A47C 16/02* (2013.01); *A47B 3/002* (2013.01)

(58) Field of Classification Search
CPC .. A47C 12/00; A47C 4/04; A47C 9/10; A47C 16/02; A47B 3/002; E06C 1/393; E06C 1/3835
USPC ..... 297/16.2, 423.14; 108/115, 128; 312/258; 182/222
See application file for complete search history.

(56) References Cited

U.S. PATENT DOCUMENTS

| | | | | | |
|---|---|---|---|---|---|
| 943,236 | A | * | 12/1909 | Campbell | A47B 3/00 312/258 |
| 3,009,752 | A | * | 11/1961 | Margulis | A47B 17/00 312/258 |
| 3,346,317 | A | * | 10/1967 | Peggs | A47F 5/108 312/258 |
| 3,650,562 | A | | 3/1972 | Adler | |
| 3,993,003 | A | | 11/1976 | James | |
| 4,010,699 | A | | 3/1977 | Lakso | |
| 4,437,413 | A | * | 3/1984 | O'Brian | A47C 4/04 108/162 |
| 4,958,652 | A | * | 9/1990 | Maya | E04H 15/58 135/900 |
| 5,244,255 | A | * | 9/1993 | Mill | A47C 16/02 248/222.52 |
| 5,518,084 | A | | 5/1996 | Short et al. | |
| 5,882,098 | A | * | 3/1999 | Brown | A47B 81/06 312/258 |
| 5,954,412 | A | * | 9/1999 | Rutherford | A01K 63/003 108/162 |

(Continued)

*Primary Examiner* — Robert Canfield
(74) *Attorney, Agent, or Firm* — AVEK IP, LLC

(57) ABSTRACT

A collapsible step stool includes a front riser extending; a left riser connected to the left side of the front riser; a right riser connected to the right side of the front; a top step connected to the top end of the front riser; the left riser, right riser, and top step hinge relative to the front riser; a left riser stopper extending from the left riser; and a right riser stopper extending from the right riser; the left riser stopper and the right riser stopper are to engage with the top step to maintain the left riser and the right riser in a position relative to the top step when the collapsible step stool is in an assembled configuration; and the front riser, left riser, right riser, and top step fold together when the collapsible step stool is in a collapsed configuration.

11 Claims, 15 Drawing Sheets

(56) References Cited

U.S. PATENT DOCUMENTS

| | | | | |
|---|---|---|---|---|
| 6,039,419 | A * | 3/2000 | Brown | A47B 3/0803 312/258 |
| 6,082,838 | A * | 7/2000 | Bissu-Palombo | A47B 21/0314 108/50.01 |
| 6,314,892 | B1 * | 11/2001 | Favini | A47B 3/0803 108/115 |
| 6,568,506 | B1 | 5/2003 | Donnalley | |
| 6,966,404 | B2 | 11/2005 | Meeker | |
| 6,997,115 | B2 * | 2/2006 | Lockwood | A47B 3/0803 108/115 |
| 7,007,771 | B2 | 3/2006 | Rawlings et al. | |
| 7,234,415 | B2 * | 6/2007 | Dietz | A01K 1/033 119/482 |
| 8,113,605 | B2 * | 2/2012 | Ceballos-Godefroy | A47F 5/10 108/115 |
| D665,180 | S * | 8/2012 | Ekelchik | D6/353 |
| 8,875,840 | B2 | 11/2014 | Chancler | |
| 10,694,859 | B1 | 6/2020 | Wickland | |
| 11,523,682 | B2 * | 12/2022 | O'Gara | A47B 21/02 |
| 2010/0187041 | A1 | 7/2010 | Crouch | |
| 2014/0131138 | A1 | 5/2014 | Simpson et al. | |
| 2014/0165884 | A1 * | 6/2014 | O'Gara | A47B 3/002 108/115 |
| 2018/0072482 | A1 * | 3/2018 | Mitchell | B65D 43/22 |
| 2019/0233122 | A1 * | 8/2019 | Maslakow | B32B 3/266 |

* cited by examiner

COLLAPSIBLE, SINGLE STEP STOOL

RELATED APPLICATIONS

This application claims priority to U.S. Application No. 63/337,732, filed May 3, 2022, incorporated by reference in its entirety herein.

FIELD OF INVENTION

The field of the present invention relates to step stools, more specifically, to a collapsible step stool comprising a single step, top step, or tier, and that is compact, portable, and able to support a weight load of an adult.

DESCRIPTION OF RELATED ART

Step stools are known and come in various configurations to serve diverse purposes, for use by persons of various ages and heights, and able to bear a wide range of body weight loads. Step stools may be a single step, top step, or tier, or multiple steps, treads, or tiers, to provide different heights of step stools to enable access to out-of-reach cabinets, counters, shelves, and the like, that cannot be reached by a person, or user, unaided. Step stools may also be in a fixed configuration, or a collapsible configuration, to allow for easy storage and portability by the user.

U.S. Pat. No. 3,650,562 issued Mar. 21, 1917, by Adler for Folding Footstool discloses a folding footstool which, when in its operative position, has a main box-like structure forming a foot supporting portion with a pair of pedestals supporting the main structure. In its inoperative position, the hingeable panels forming the main structure, are adapted to embrace the pedestals so that a neat and compact box is provided for carrying purposes.

U.S. Pat. No. 3,993,003 issued Nov. 23, 1976, by James for Collapsible Stool discloses a collapsible stool including a plurality of slats which are connected in side-by-side relationship by a plurality of flexible material hinges which permit the slats to be positioned in a folded-up configuration for transportation and storage. A pair of arms are pivotably connected to the bottom surfaces of the outer slats, at the opposite corners of the stool, so that the arms may be positioned parallel to the slats or perpendicular thereto. Each arm supports a pair of legs at the opposite ends thereof which are collapsible with the arms or extendable outwardly to support the stool above a surface. A locking mechanism made integral with two of the legs locks the free ends of the arms to the slats when the legs are extended outwardly.

U.S. Pat. No. 4,010,699 issued Mar. 8, 1977, by Lasko for Self-Erecting Folding Step Stool discloses a self-erecting step stool comprising a top, pivoted leg structures at the ends of the top, a pivoted leg holding strut between the legs and having positive engagement therewith when the legs are extended; a strengthening rib secured or integral to the top at the underside thereof, said pivoted strut being pivoted in journals which are secured to said strengthening rib whereby sidewise thrust on the leg structures at the ends of the step stool is transferred through the pivoted strut to the strengthening rib and thence to the top.

U.S. Pat. No. 5,518,084 issued May 21, 1996, by Short et al. for Portable Step discloses a new and improved portable step comprising a top platform having a front portion that extends downwardly therefrom. The top platform has a metal edging around a periphery thereof. The metal edging serves to protect the periphery from chipping and splitting. Included in the device are two side supports. Each of the two side supports has a spring loaded hinge there secured. Each spring loaded hinge is secured to the top platform. Each of the two side supports is extendable to a position perpendicular to the top platform. Each of the two side supports is foldable to a position against the top platform. A front support is hingedly secured to the front portion of the top platform. The front support is extendable to a position perpendicular to the top platform resting against the two side supports. The front support is foldable to a position retaining the two side supports against the top platform.

U.S. Pat. No. 6,568,506 issued May 27, 2003, by Donnalley for Portable Child's Stool with Storage Compartment discloses a collapsible step stool with a storage cavity for storing a wipes container is described that includes a platform having upper, side and end walls that together form a storage cavity beneath the upper wall; a removable support shelf with a first access opening positionable beneath the storage cavity; and legs pivotally attached to the platform, the legs being moveable between a closed position beneath the platform and an opened position, the legs having cut-out sections forming a second access opening aligned with the first access opening when the legs are in the closed position to provide access into the storage cavity.

U.S. Pat. No. 6,966,404 issued Nov. 22, 2005, by Meeker for Folding Step Stool discloses a step stool includes a step and at least two legs coupled to the step. The step stool further includes a locking mechanism that, when activated, allows the legs to fold parallel to the step.

U.S. Pat. No. 7,007,771 issued Mar. 7, 2006, by Rawlings et al. for Collapsible Stool discloses a collapsible stool to provide additional height for small children undergoing toilet training, comprising: a substantially horizontal top plate of generally rectangular shape with an upper surface and a lower surface; four protrusions integral with the lower plate surface and each separately located proximal to the four corners of the top plate, wherein each protrusion is host to a hollow core to provide two pairs of female cores approximately cylindrical in shape; and two legs, each leg having two opposite facing male protrusions each adapted to fit the female cores to enable each leg to rotate through an arc between an open position and a closed position relative to the top plate, wherein at least one of each pair of female cores comprise an integral leg security mechanism adapted to maintain each leg in an open position relative to the top plate.

U.S. Pat. No. 8,875,840 issued Nov. 4, 2014, by Chancler for Collapsible Stool discloses a collapsible stool with foldable legs as well as a foldable seat is disclosed herein. The stool collapses to greatly reduce its size thereby enabling it to fit within many common carrying articles, such as purses. The legs and support members fold flat against the seat of the stool, which itself is in two pieces and folds in half.

U.S. Pat. No. 10,694,859 issued Jun. 30, 2020, by Wickland for Collapsible Travel Stool discloses a collapsible travel stool with an inclined top that may be used as a footrest. The top surface, the left side wall, and the right side wall may be hinged so that the collapsible travel stool collapses flat for storage and transport. The top surface may be an inclined plane adapted for a user to place their feet upon when the collapsible travel stool is open and in front of a seat. As a non-limiting example, the collapsible travel stool may be used on a commercial aircraft to improve comfort during long trips.

US Patent Application 2010/0187041 published Jul. 29, 2010, by Crouch for Child's Portable Collapsible Step Stool discloses a compact; collapsible or folding, one tier, step stool for children that easily transforms into a smaller unit which is lightweight and portable. It has the advantages of being child friendly, lightweight, cleanable and becomes compact in the closed position for storage. In that state it could easily be transported by a child or carried in an adult's carrying bag, or a child could carry it in hand or in their bag/backpack. A child could also use it as a seat or table.

US Patent Application 2014/0131138 published May 15, 2014, by Simpson et al. for Folding Stool discloses a folding stool that has trapezoidal sides including front and rear nonfolding side walls and left and right folding end walls. Each end wall includes first and second nonfolding half-walls and a hinge connecting these half-walls to each other. The folding stool includes a nonfolding top wall connected to the top of the front side wall by a hinge and a strut connected proximate the middle of the top wall at one end and proximate the top of the rear side wall at the other end. The top wall extends horizontally outwardly from the left and right end walls and rear side wall when the folding stool is in its unfolded position to rest upon the left and right end walls and rear side wall to support weight placed upon the folding stool. The folding stool folds so that the top face of the top wall is coplanar with the outer face of the front side wall when in the folded position.

Despite the diversity of step stools, there remains a need for a step stool that is small, lightweight, able to bear the weight of an adult, collapsible, compact, portable, and able to assist a user with daily activities requiring access to heights unreachable by the user unaided. In particular, there is a need for a step stool for use by a person, or user, of average stature or less in height, who faces daily challenges in accessing items, cabinets, counters, and shelves at levels beyond the user's unaided reach.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

The present invention is a collapsible step stool comprising a single step, tread, or tier, and which is compact, portable, and able to support a weight load of an adult. The step stool is readily transportable by the user and is easily and quickly configured and collapsed, which allows for convenient, repeated set-up, use, and collapse by the user. When configured for use, the step stool measures from about 6.0 inches to about 8.0 inches in height, from about 10.0 inches to about 12.0 inches in width, and from about 6.0 inches to about 8.0 inches in length. When collapsed, the step stool measures from about 6.0 inches to about 8.0 inches in height, from about 10.0 inches to about 12.0 inches in width, and from about 1.5 inches to about 3.0 inches in length.

BRIEF DESCRIPTION OF THE DRAWINGS

Embodiments of the invention are described in detail below with reference to the attached drawings.

Figure 1:
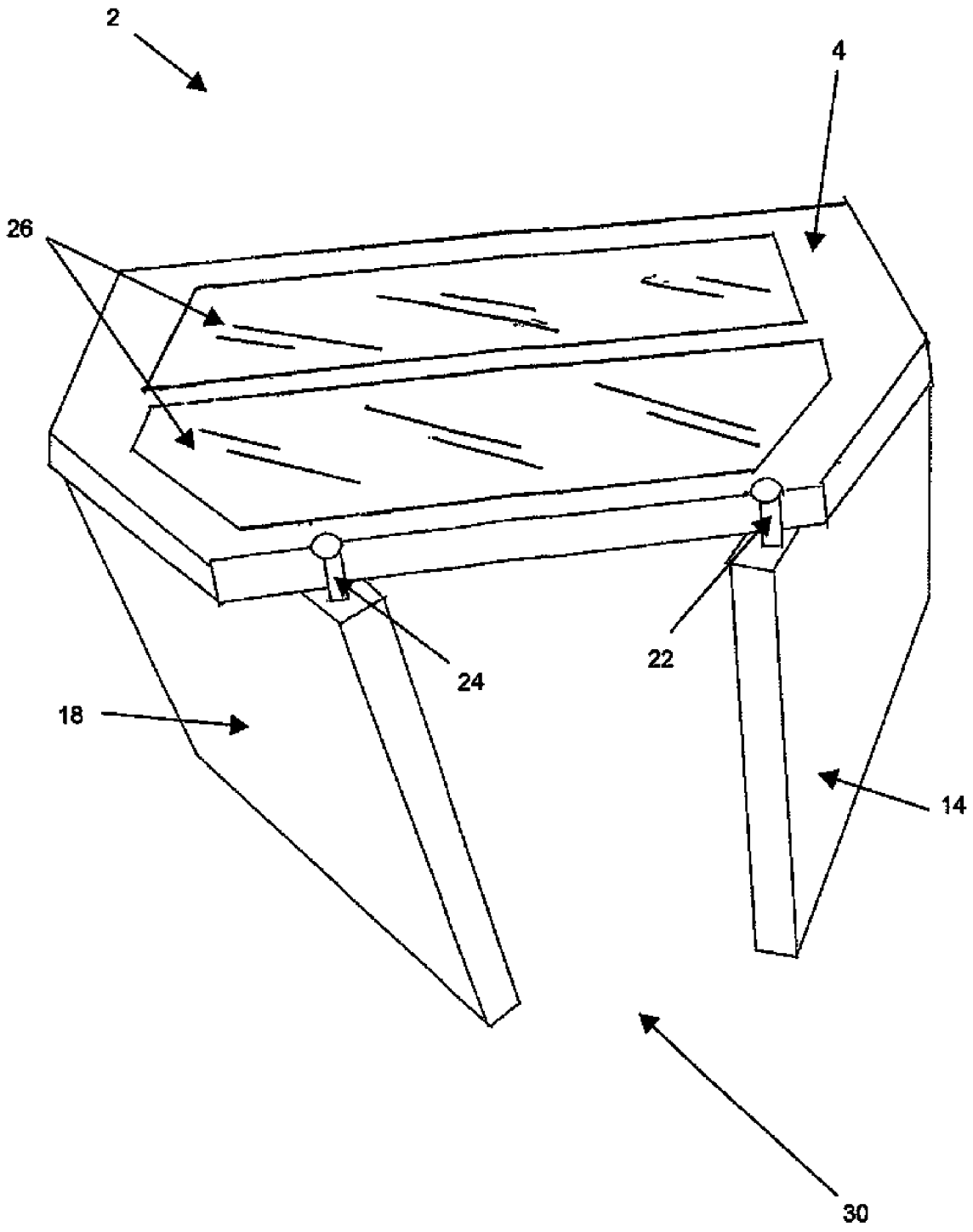
FIG. 1 is a back side perspective view of a step stool of the present invention in an assembled configuration for use.

LIST OF REFERENCE NUMERALS FOR AN EMBODIMENT OF THE COLLAPSIBLE STEP STOOL DISCLOSED IN FIGS. 1-10.

2 step stool
4 top step
6 front riser
8 left flange
10 right flange
12 front riser hinge
14 left riser
16 left riser hinge
18 right riser
20 right riser hinge
22 left riser stopper
24 right riser stopper
26 non-slip surface
28 front side of step stool
30 back side of step stool

LIST OF REFERENCE NUMERALS FOR AN EMBODIMENT OF THE COLLAPSIBLE STEP STOOL DISCLOSED IN FIGS. 11-15.

100 step stool
102 top step
104 front riser
106 left riser
108 right riser
110 right flange
112 top flange
114 first living hinge
116 second living hinge

118 third living hinge
119 fourth living hinge
120 left riser stopper
122 right riser stopper
124 left aperture
126 right aperture
128 snap lock
129 inner surface of front riser
130 first opening
132 second opening
134 third opening The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

The present invention addresses the need for a step stool that is small, lightweight, able to bear the weight of an adult, collapsible, compact, portable, and able to assist a user with daily activities requiring access to heights unreachable by the user unaided. The present invention is a collapsible, single step stool which has a single step, tread, or tier, and is compact, portable, and able to support a weight load of an adult.

The average height or stature in the United States for a woman is about 5 feet 4inches, and for a man is about 5 feet 9 inches. A person, or user, of about average or less height or stature, and in particular for a user less than or about 5.0 feet, or 1.5 meters, in height, faces daily challenges in accessing items, cabinets, counters, and shelves at levels beyond the user's unaided reach. These challenges arise within the user's residence, workplace, and public places. An example of a common public place that poses a challenge for a user of about average or less height or stature is a grocery store, and the ability of the user to access items on mid-level or higher level shelves.

Because the step stool of the present invention is collapsible and compact, the step stool is readily transportable by the user and enables the user to carry, and use, the step stool everywhere the user goes with ease and minimal effort. The step stool of the present invention is easily and quickly configured and collapsed, which allows for convenient, repeated set-up and use by the user, such as multiple uses during a single shopping trip to a grocery store.

Figure 7:
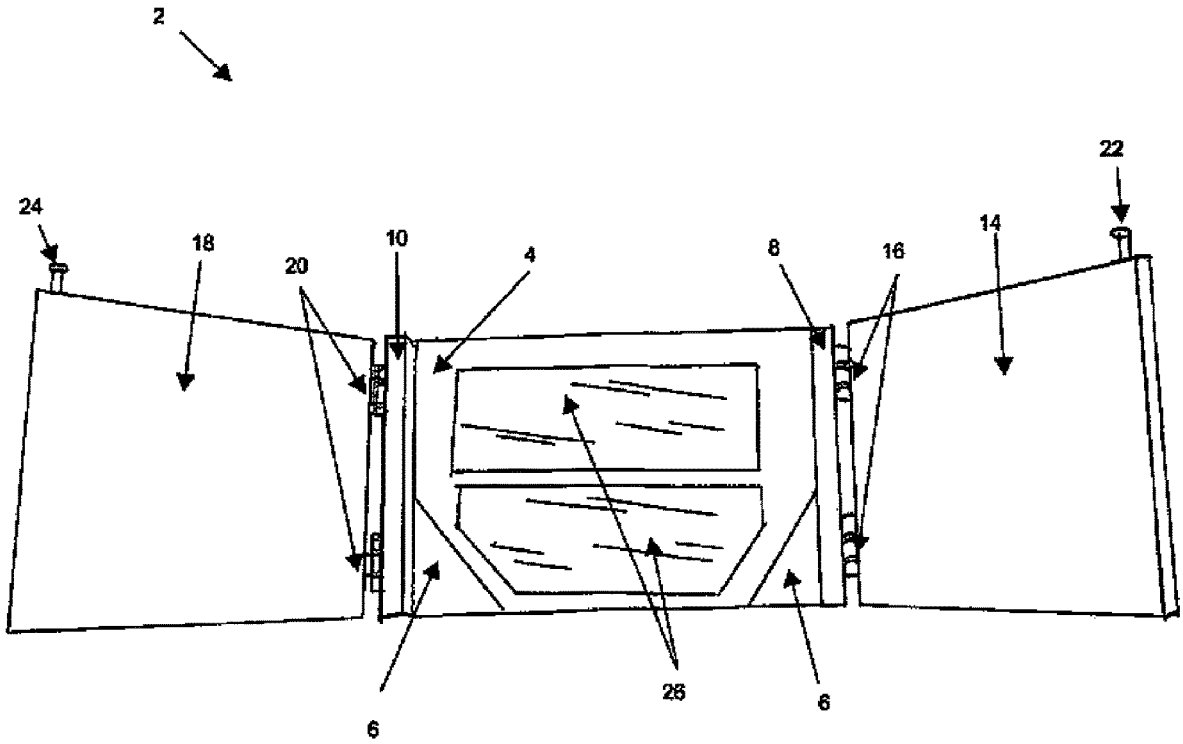
FIG. 7 is a bottom side perspective view of the step stool of the present invention in a second phase of collapsing the step stool.
Figure 8:
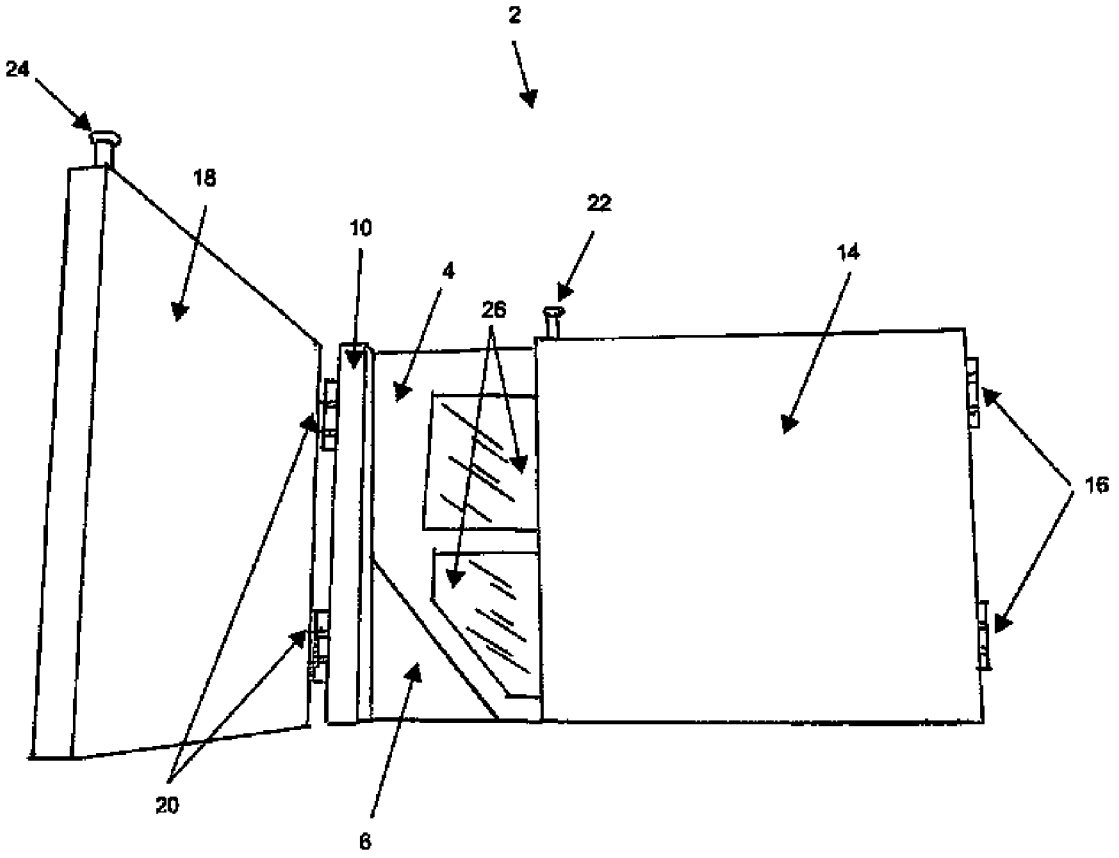
FIG. 8 is a bottom side perspective view of the step stool of the present invention in a third phase of collapsing the step stool.
Figure 9:
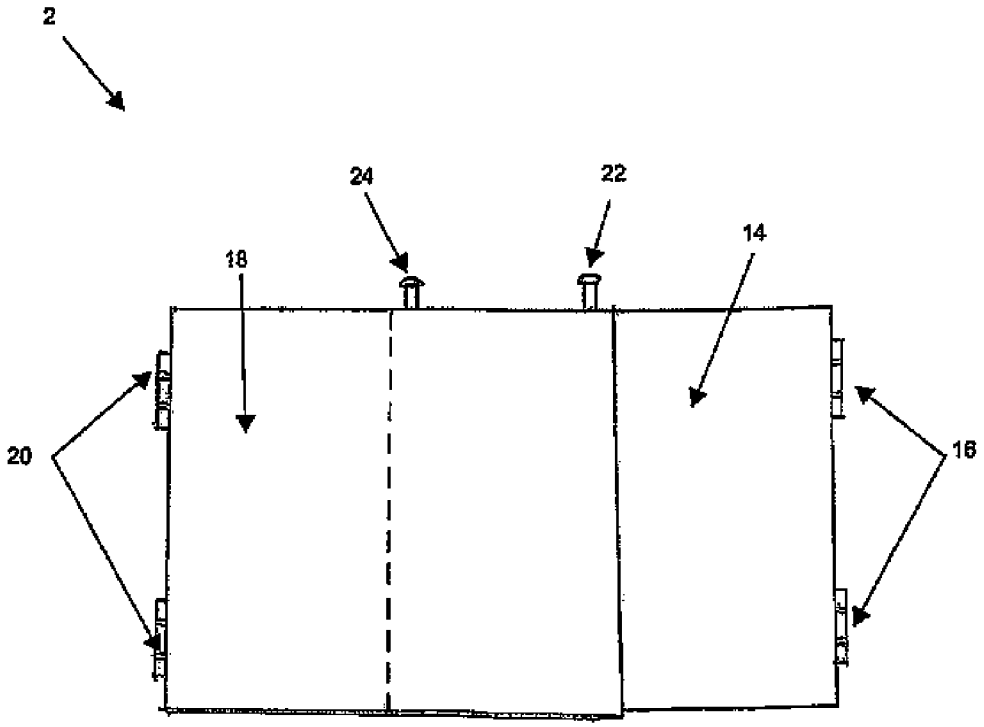
FIG. 9 is a bottom side plan view of the step stool of the present invention in a fourth phase of collapsing the step stool.
Figure 10:
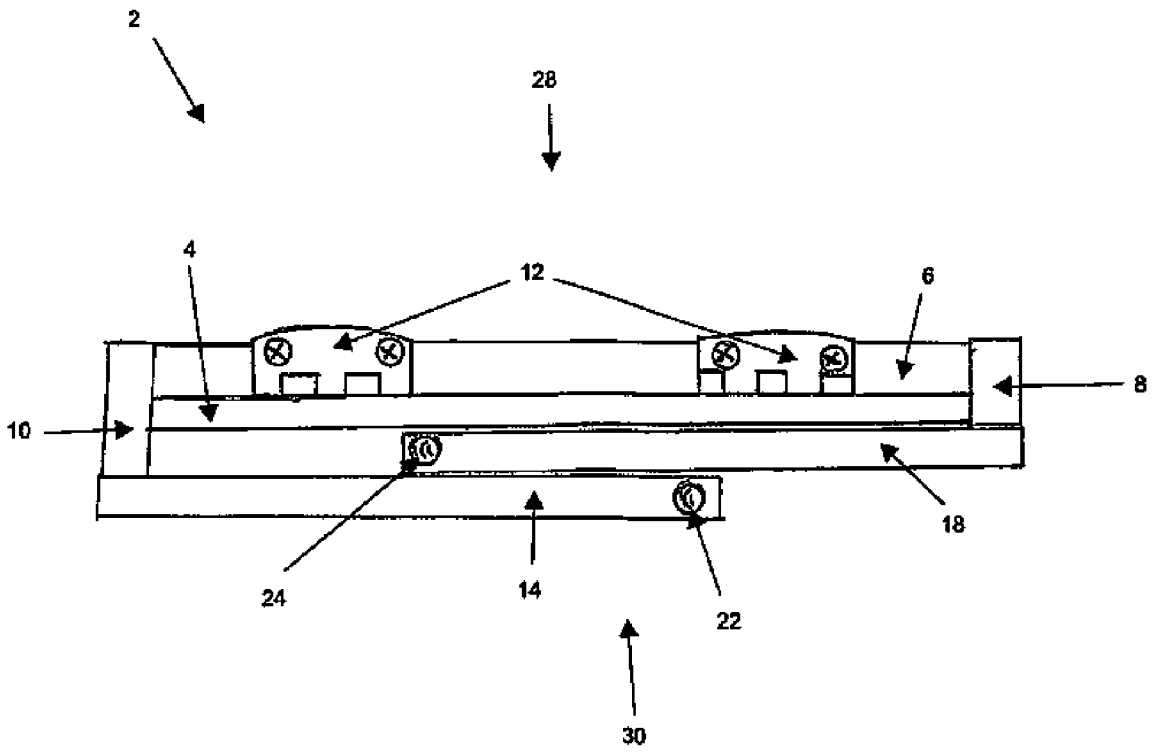
FIG. 10 is a top side plan view of the step stool of the present invention in a collapsed configuration.
Figure 11:
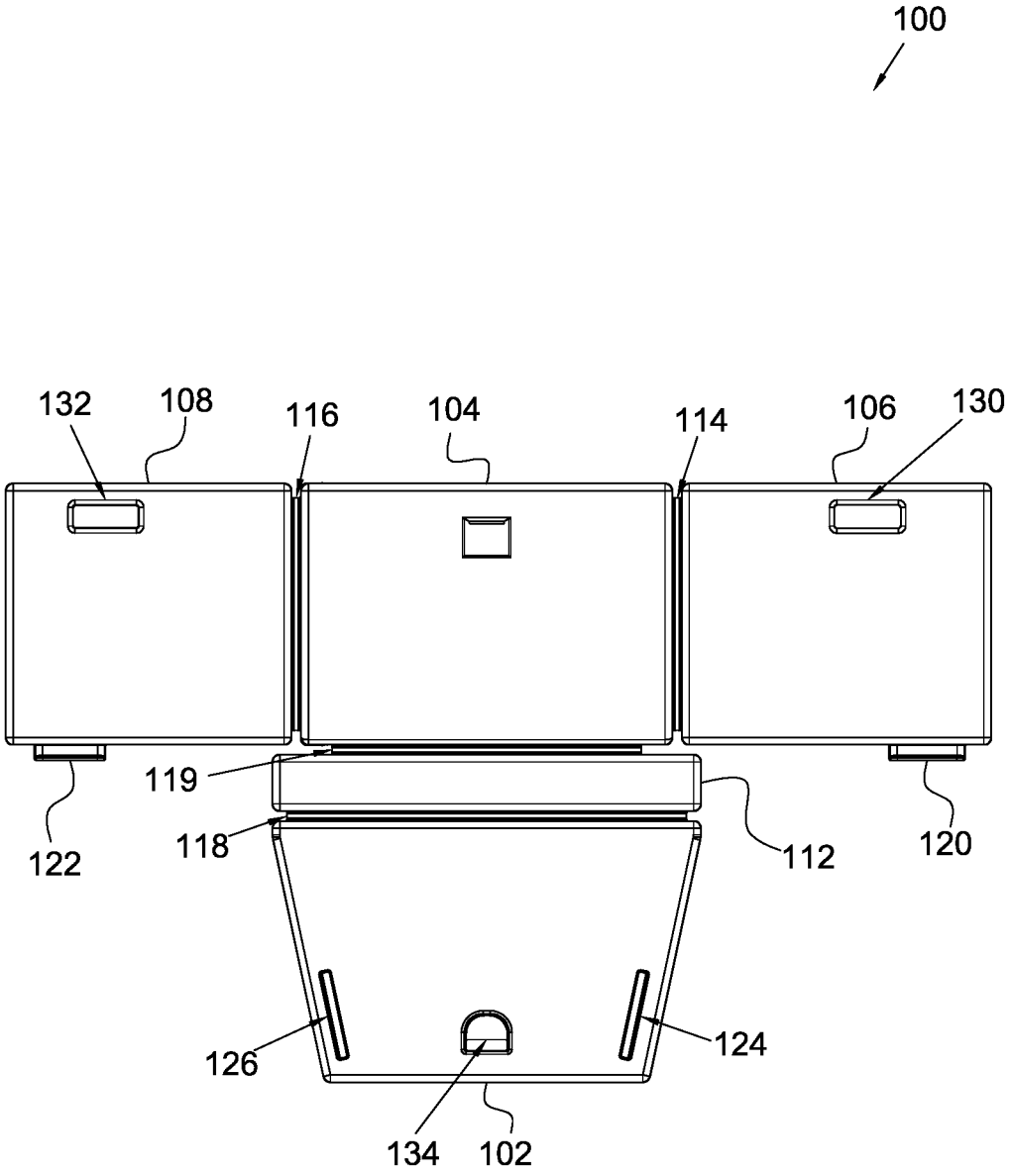
FIG. 11 is a top view of an alternative embodiment of a collapsible step stool in an open configuration.

A first embodiment of a collapsible step stool 2 in accordance with the present invention is shown in FIGS. 1-10. The step stool of the present invention comprises a single top step, tread, or tier. When configured or assembled for use by a user as shown in FIG. 1, FIG. 2, FIG. 3, and FIG. 4, the step stool 2 measures from about 6.0 inches to about 8.0 inches in height (bottom to top), from about 10.0 inches to about 12.0 inches in width (left to right), and from about 6.0 inches to about 8.0 inches in length (front to back). When configured or collapsed by a user as shown in FIG. 9 and FIG. 10, the step stool 2 measures from about 6.0 inches to about 8.0 inches in height (bottom to top), from about 10.0 inches to about 12.0 inches in width (left to right), and from about 1.5 inches to about 3.0 inches in length (front to back).

The step stool of the present invention may be constructed from any sturdy material able to bear a weight load of at least that of an average adult. The average weight in the United States for a woman is about 162 pounds, and for a man is about 181 pounds. Suitable sturdy materials are wood, plastic, and metal, such as aluminum.

As shown in FIG. 1, FIG. 2, FIG. 3, FIG. 4, and FIG. 5, the step stool 2 of the present invention is configured or assembled for use by a user. As shown in FIG. 6, FIG. 7, FIG. 8, and FIG. 9, the step stool 2 of the present invention is in various phases of being collapsed, or conversely, being assembled or configured for use, and in FIG. 10 is collapsed for easy portability by the user. As shown in FIG. 1 through FIG. 10, a front riser 6, a left flange 8, a right flange 10, a left riser 14, and a right riser 18 preferably are rectangular in shape. As shown in FIG. 1 through FIG. 8, a top step 4 preferably is hexagonal in shape, but may also be rectangular in shape, or in the shape of any appropriate polygon; wherein the preferred hexagonal shape of the top step 4 enables the step stool 2 to be easily assembled and collapsed by a user, and confers the step stool 2 with a compact footprint in use.

Figure 4:
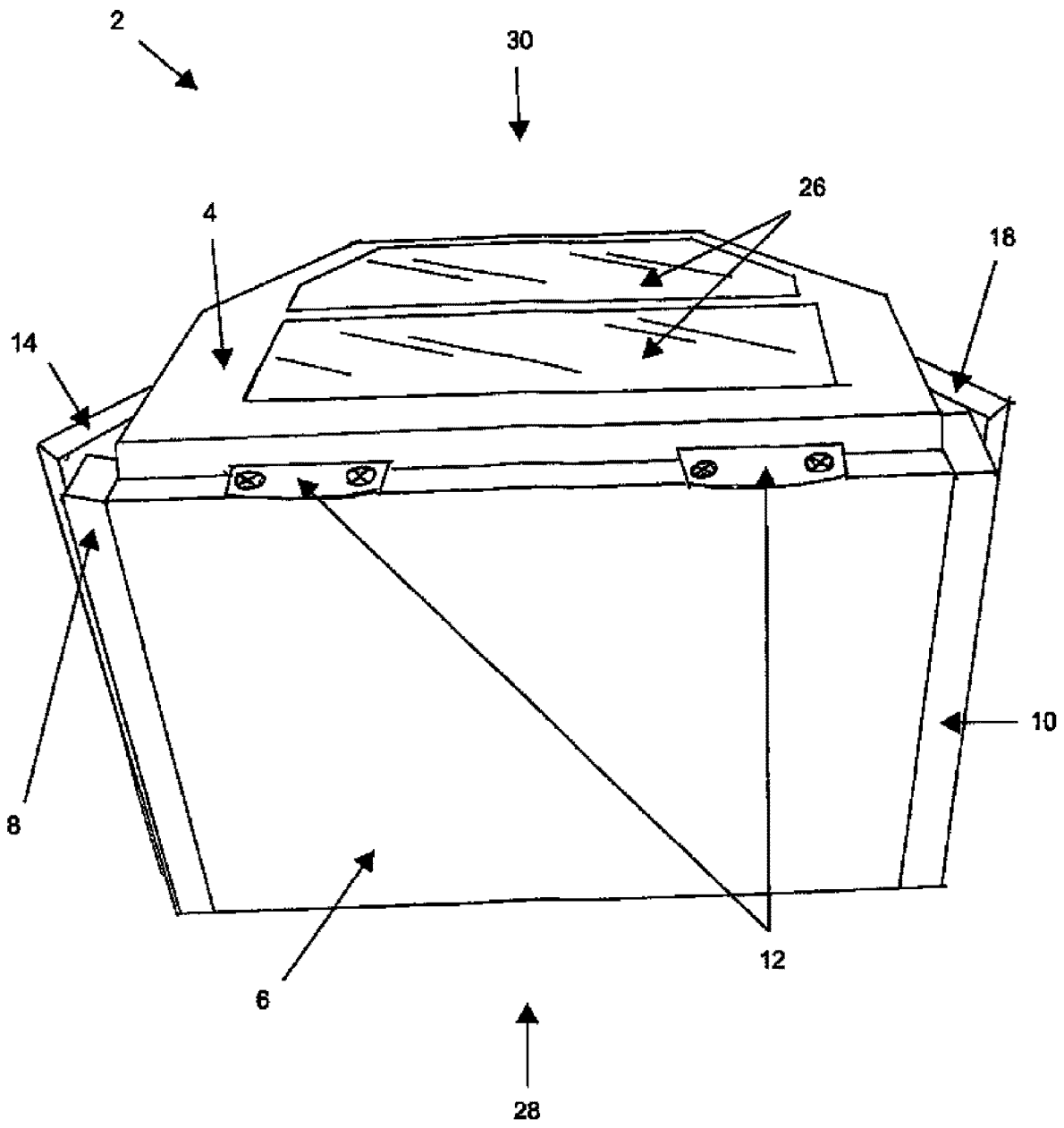
FIG. 4 is a front side perspective view of the step stool of the present invention in an assembled configuration for use.

With reference to FIG. 1, the step stool 2 of the present invention is shown configured for use by the user. To use the step stool 2, as shown in FIG. 4, the user places the step stool 2 on the ground, with a front side 28 of step stool 2 facing toward the user, and a back side 30 of step stool 2 facing away from the user, and the user steps on a top step 4, with either foot, or with both feet, per the user's discretion. Optionally, the top step 4 may have a non-slip surface 26 to enhance safety of use of the step stool 2 and prevent slippage of the user's foot or feet on the top step 4 while using the step stool 2.

With reference to FIG. 1, FIG. 2, FIG. 3, FIG. 4, and FIG. 5, the top step 4 of the step stool 2 is in articulable connection with the front riser 6 by means of at least a front riser hinge 12. The front riser hinge 12 enables the top step 4 and the front riser 6 to be configured in relation to each other from about 90 degrees for use of the step stool 2, to about 0 degrees with the top step 4 folded toward and upon the front riser 6 when the step stool 2 is collapsed. The front riser 6 is fixedly connected at about 90 degrees to each of a left flange 8 at a left side edge of the front riser 6, and to a right flange 10 at a right side edge of the front riser 6.

Figure 2:
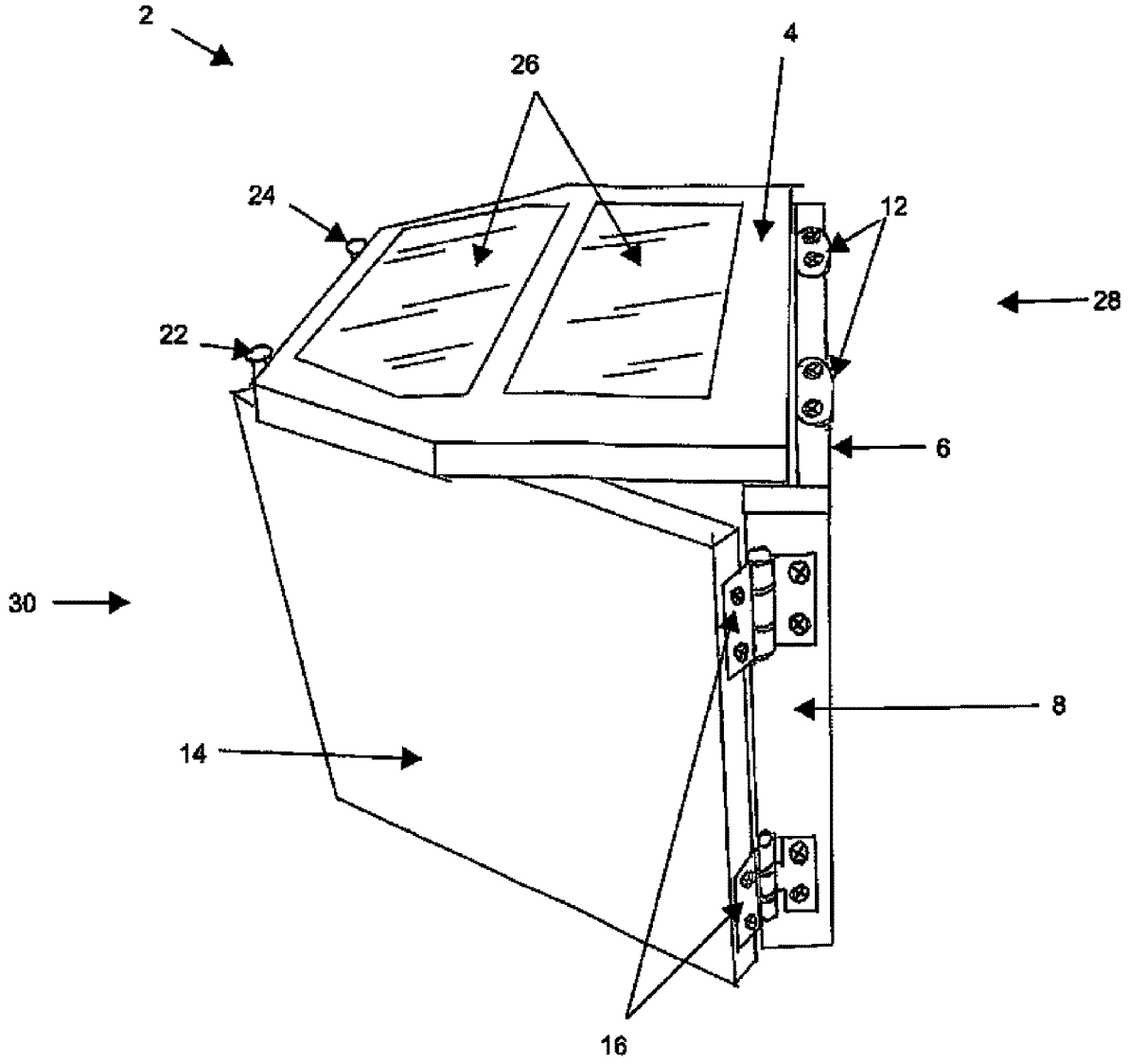
FIG. 2 is a left side perspective view of the step stool of the present invention in an assembled configuration for use.
Figure 3:
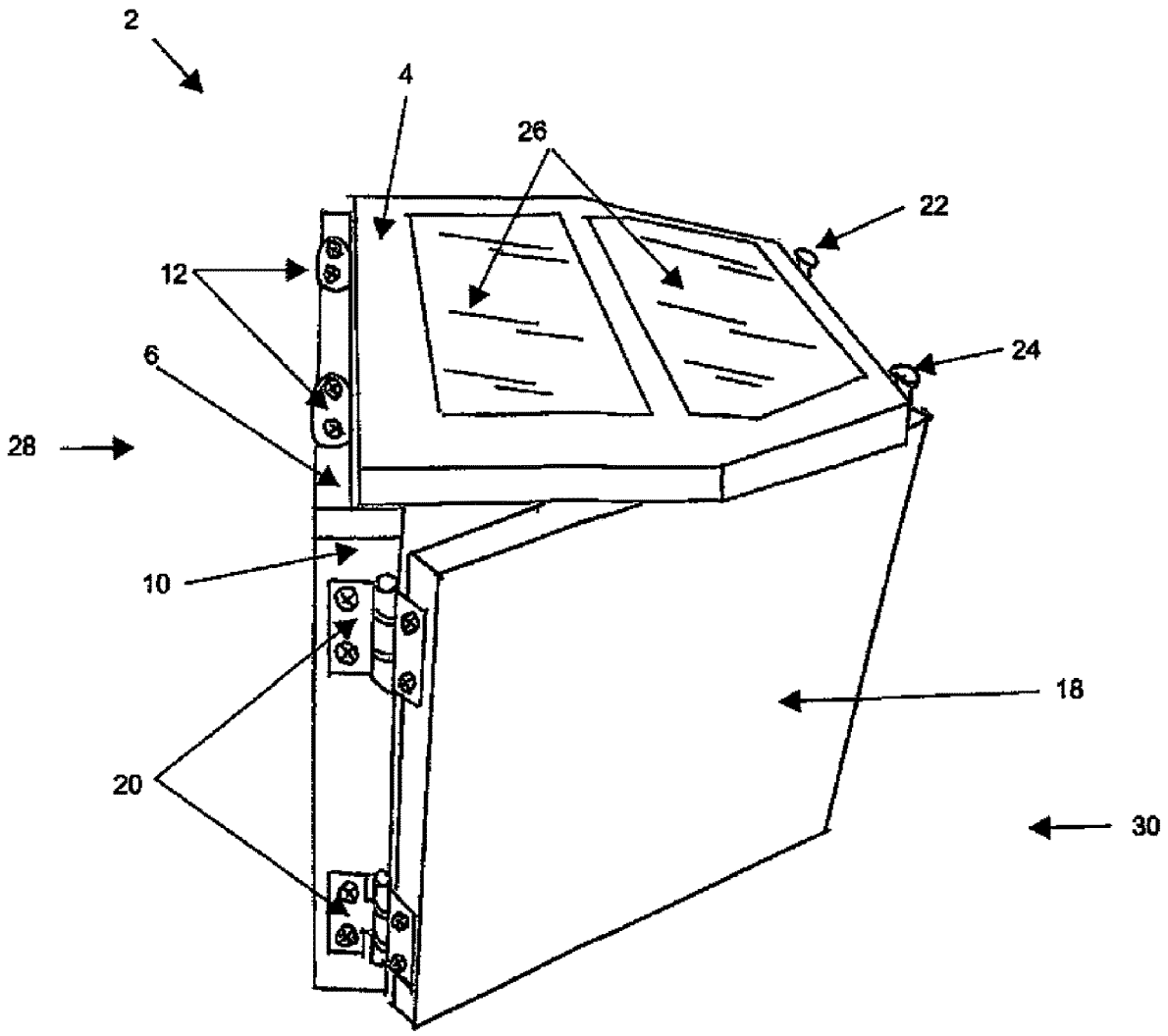
FIG. 3 is a right-side perspective view of the step stool of the present invention in an assembled configuration for use.

With reference to FIG. 2, and FIG. 3 the left flange 8 is in articulable connection with a left riser 14 by means of at least a left riser hinge 16, and the right flange 10 is in articulable connection with a right riser 18 by means of at least a right riser hinge 20. As shown in FIG. 4, FIG. 5, FIG. 6, and FIG. 10, the left flange 8 and the right flange 10 have the same height and width measurements; however, the left flange 8 measures less in length than the right flange 10, which difference in length measurement allows the step stool 2 to be configured in a collapsed position as shown in FIG. 10. Also as shown in FIG. 10, the difference in length measurement between the left flange 8 and the right flange 10 is about the same measurement as a width or thickness of the right riser 18.

With reference to FIG. 2 and FIG. 3, the left riser hinge 16 enables the left flange 8 and the left riser 14 to be configured in relation to each other from about 180 degrees in a fully open position, to about 60 degrees for use of the step stool 2, to about 0 degrees with the left riser 14 folded toward the front riser 6 and resting upon the top step 4 when the step stool 2 is collapsed. The right riser hinge 20 enables the right flange 10 and the right riser 18 to be configured in relation to each other from about 180 degrees in a fully open position, to about 60 degrees for use of the step stool 2, to about 0 degrees with the right riser 18 folded toward the front riser 6 and resting upon the left riser 14 when the step stool 2 is collapsed.

With reference to FIG. 1, FIG. 2, and FIG. 3, the left riser 14 has a left riser stopper 22 positioned toward an outside edge of a top side of the left riser 14, and the right riser 18 has a right riser stopper 24 positioned toward an outside edge of a top side of the right riser 18. When the step stool 2 is configured for use the left riser stopper 22 abuts the top step 4 and maintains the left riser 14 in place in relation to and in support of the top step 4, and the right riser stopper 24 abuts the top step 4 and maintains the right riser 18 in place in relation to and in support of the top step 4. In this embodiment shown, the right riser stopper 24 and the left riser stopper 22 are posts that protrude from an edge of associated riser and a surface for the edge of the top step 4 to engage against and thereby block the edge from unwanted movement. Other embodiments may utilize other styles of stoppers 22, 24 as would be understood by those skilled in the art.

The step stool 2 of the present invention is shown in an assembled configuration for use by the user in FIG. 1, FIG. 2, FIG. 3, FIG. 4, and FIG. 5. The step stool 2 of the present invention is shown in an open configuration, or unassembled configuration, as well as in the phases of collapsing the step stool 2 to a collapsed configuration in FIG. 6, FIG. 7, FIG. 8, FIG. 9, and FIG. 10.

Figure 6:
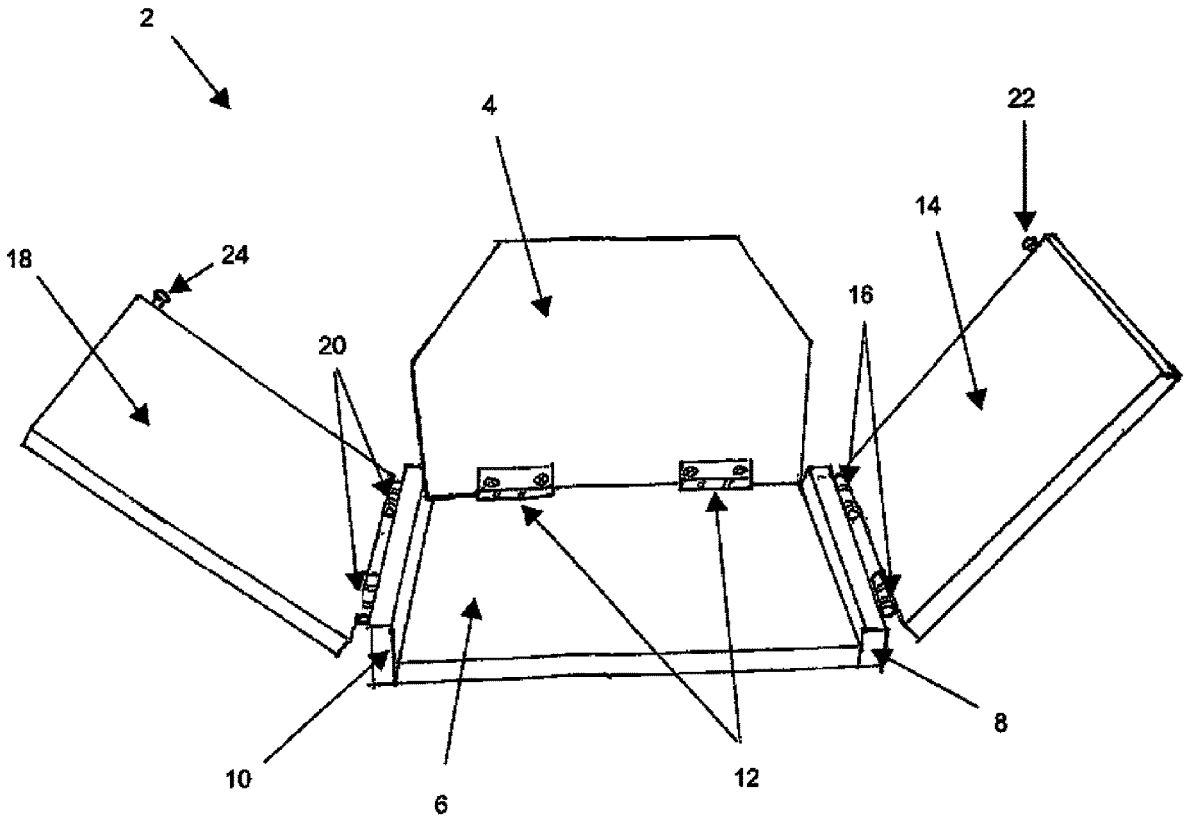
FIG. 6 is a bottom side perspective view of the step stool of the present invention in an open or unassembled configuration, and a first phase of collapsing the step stool.

With reference to FIG. 6, FIG. 7, FIG. 8, FIG. 9, and FIG. 10, the step stool 2 of the present invention is shown in the various phases of collapsing the step stool 2. First, as shown in FIG. 6, the right riser 18 and the left riser 14 are moved radially outward and away from the top step 4. Second, as shown in FIG. 7, the top step 4 is folded downward to rest upon the front riser 6. Third, as shown in FIG. 8, the left riser 14 is folded inward to rest upon the top step 4. Fourth, as shown in FIG. 9, to collapse completely the step stool 2, the right riser 18 is folded inward to rest upon the left riser 14; where the dashed line shows the outside edge of the left riser 14 underneath the right riser 18. The completely collapsed step stool 2 is also shown in FIG. 10.

Figure 5:
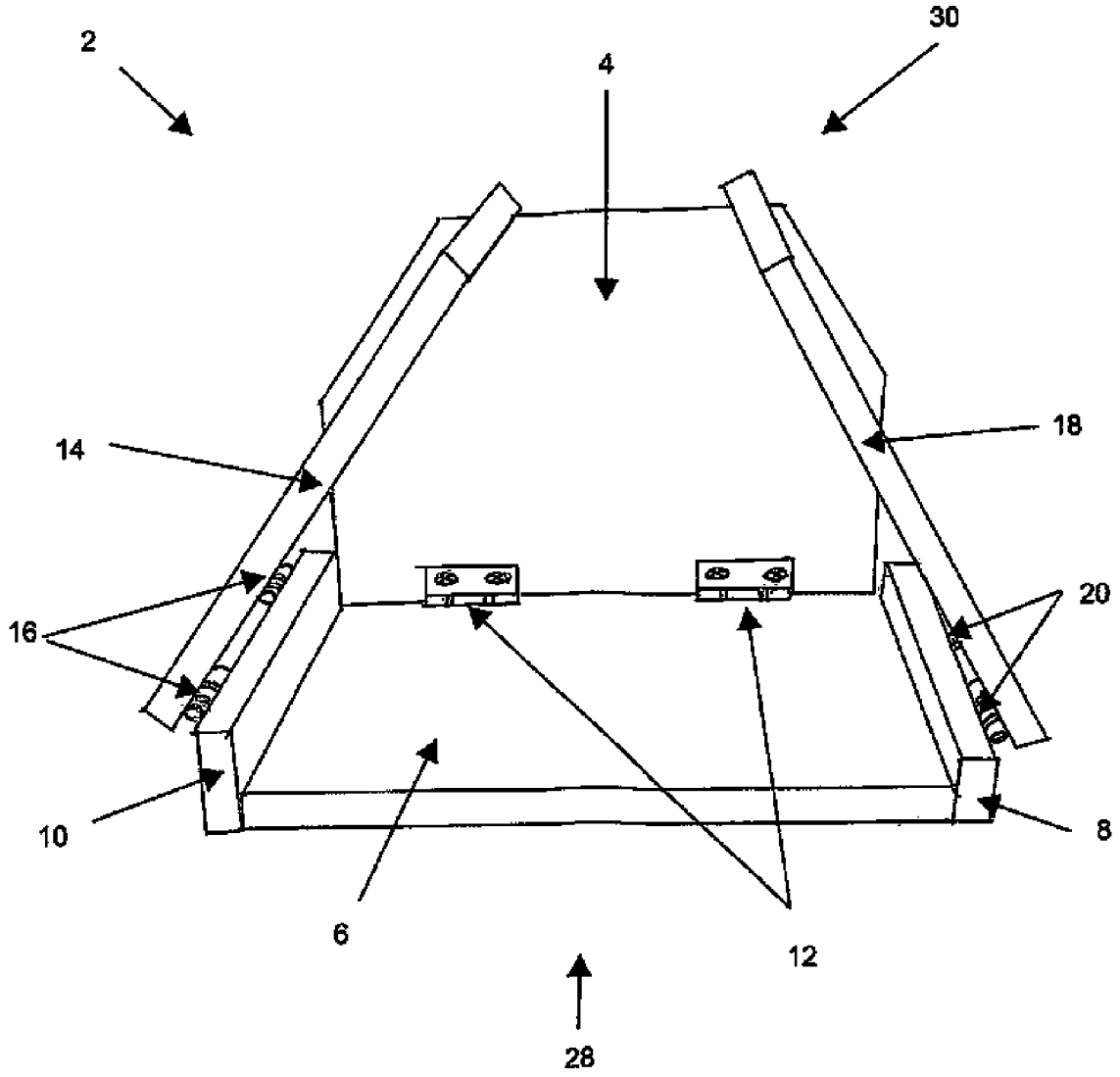
FIG. 5 is a bottom side perspective view of the step stool of the present invention in an assembled configuration for use.

To assemble, or configure, the step stool of the present invention for use, the above steps are done in reverse. First, from the collapsed configuration of the step stool 2 shown in FIG. 9 and FIG. 10, the right riser 18 is opened radially outward and away from the left riser 14 as shown in FIG. 8. Second, as shown FIG. 7, the left riser 14 is opened radially outward and away from the top step 4. Third, as shown as FIG. 6, the top step 4 is opened away from the front riser 6 until the top step 4 is positioned at a right angle, or 90 degrees, to the front riser 6. Fourth, as shown in FIG. 5, the left riser 14 and the right riser 18 are moved radially inward and toward the top step 4, until, as also shown in FIG. 1, the right riser stopper 24 and the left riser stopper 22 abut the top step 4 and the top step 4 rests upon and is supported by the left riser 14 and the right riser 18.

In FIGS. 11-15, an alternative embodiment of a collapsible step stool 100 is shown. Stool 100 is similar in form and function to stool 2 and may include some or all of the features discussed above.

Figure 12:
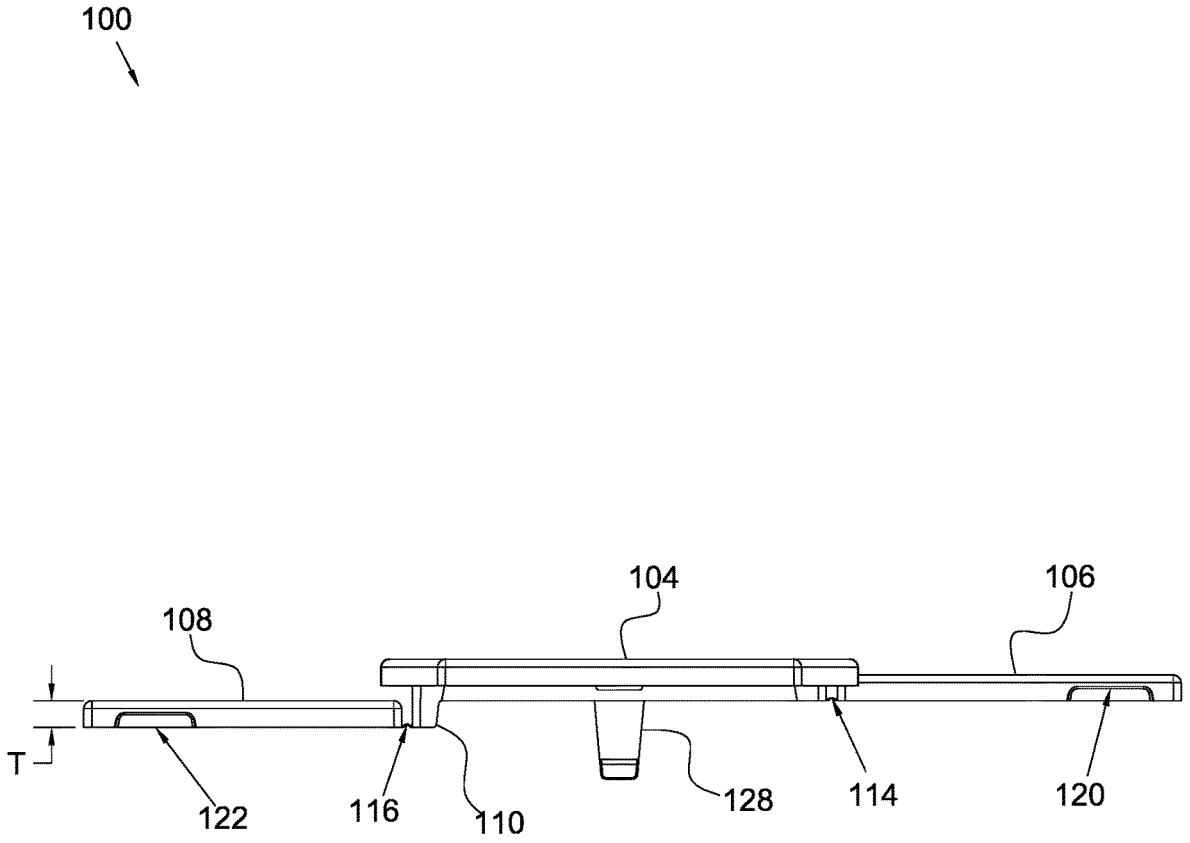
FIG. 12 is an end view of the collapsible step stool of FIG. 11.

As shown, stool 100 includes a front riser 104 extending from a top end to a bottom end and from a left side to a right side. A left riser 106 is connected to the left side of the front riser 104 such that the left riser 106 can hinge or bend relative to the front riser 104. For example, in embodiments, a first living hinge 114 connects the left and front risers 106, 104 together. A right riser 108 is connected to the right side of the front riser 104 such that the right riser 108 can hinge relative to the front riser 104. Again, a second living hinge 116 may be used to create this connection. In embodiments, a right flange 110, as best shown in FIG. 12, extends from the front riser 104 to connect to the front riser 104 to the right riser 108. The flange 110 accordingly positions the right riser 108 at a position offset from the left riser 106 such that as the stool 100 folds into the collapsed position, the flange 110 creates space for the left riser 106 to fold flat against the front riser 104. The flange 110 further holding the right riser 108 at a position to allow the right riser 108 to again fold flat against the left riser 106. This feature helps ensure that the stool 100 is in a most compact configuration when folded.

A top step 102 is further connected to the top end of the front riser 104 such that the top step 102 can hinge or bend relative to the front riser. Again, living hinges 118, 119 may be used to create this type of connection. In embodiments, a top flange 112 is positioned to connect to top step 102 via a third living hinge 118 and the front riser 104 via a fourth living hinge 119. Again, this flange 112 provides for the necessary spacing to allow the top step 102 to ultimately fold flat against the right riser 108 when in the collapsed position. The use of the third and fourth living hinges 118, 119 provides for the necessary flexible connection to allow for the folding and unfolding.

Figure 15:
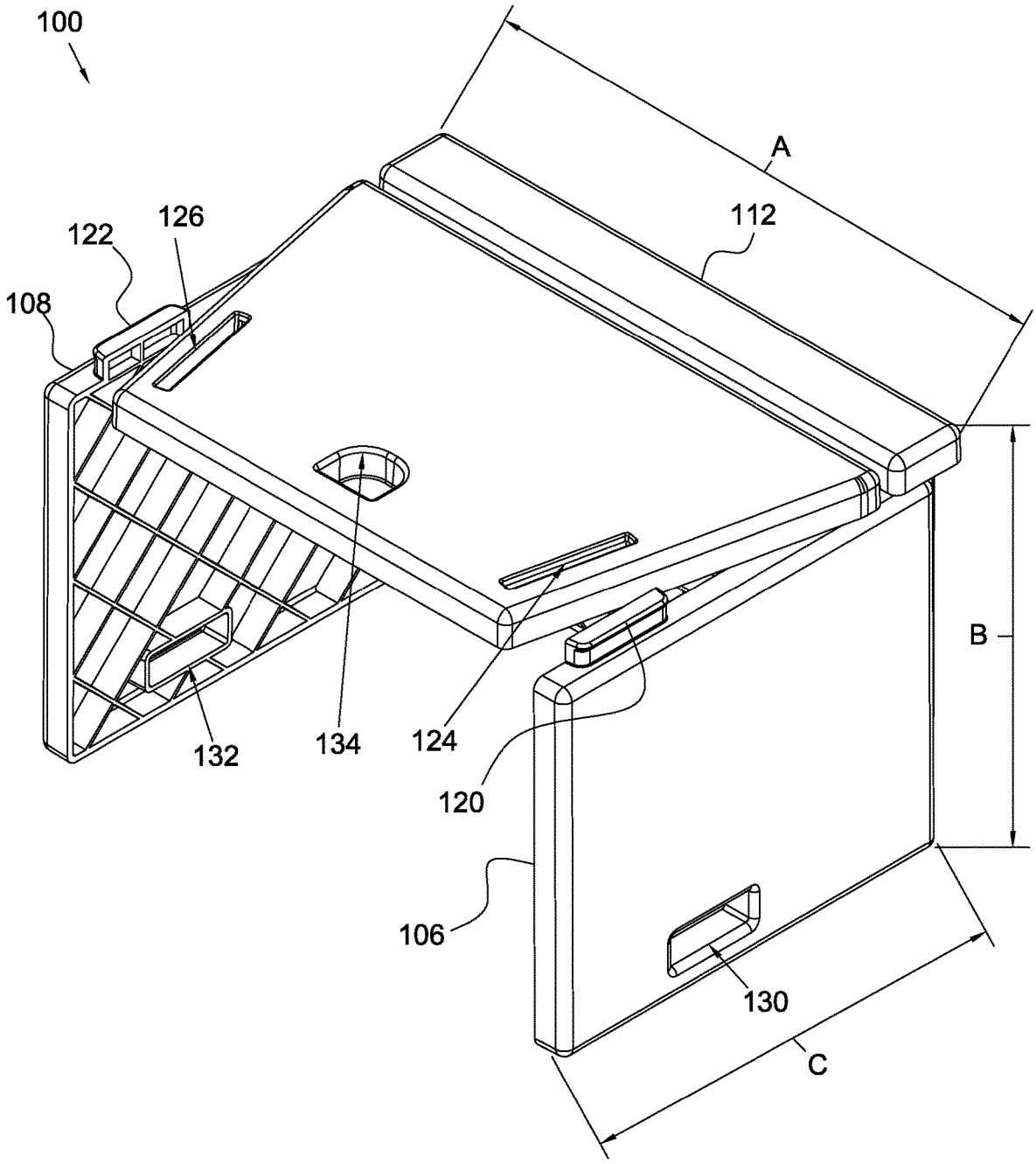
FIG. 15 is an angled view of the collapsible step stool of FIG. 11 in a second phase of assembly.

Stool 100 further includes a left riser stopper 120 extending from the left riser 106 and a right riser stopper 122 extending from the right riser 108. The left and right riser stoppers 120, 122 are configured to engage with the top step 102 to maintain the left riser 106 and the right riser 108 in a position relative to the top step 102 when the collapsible step stool 100 is in an assembled configuration. As shown in FIG. 15, as the left and right risers 106, 108 fold inward into the assembled configuration, the stoppers 120, 122 will align with the left and right apertures 124, 126 and are configured to extend therein to secure the top step in place. This provides for structural integrity of the stool 100 when in the assembled and usable configuration.

Figure 14:
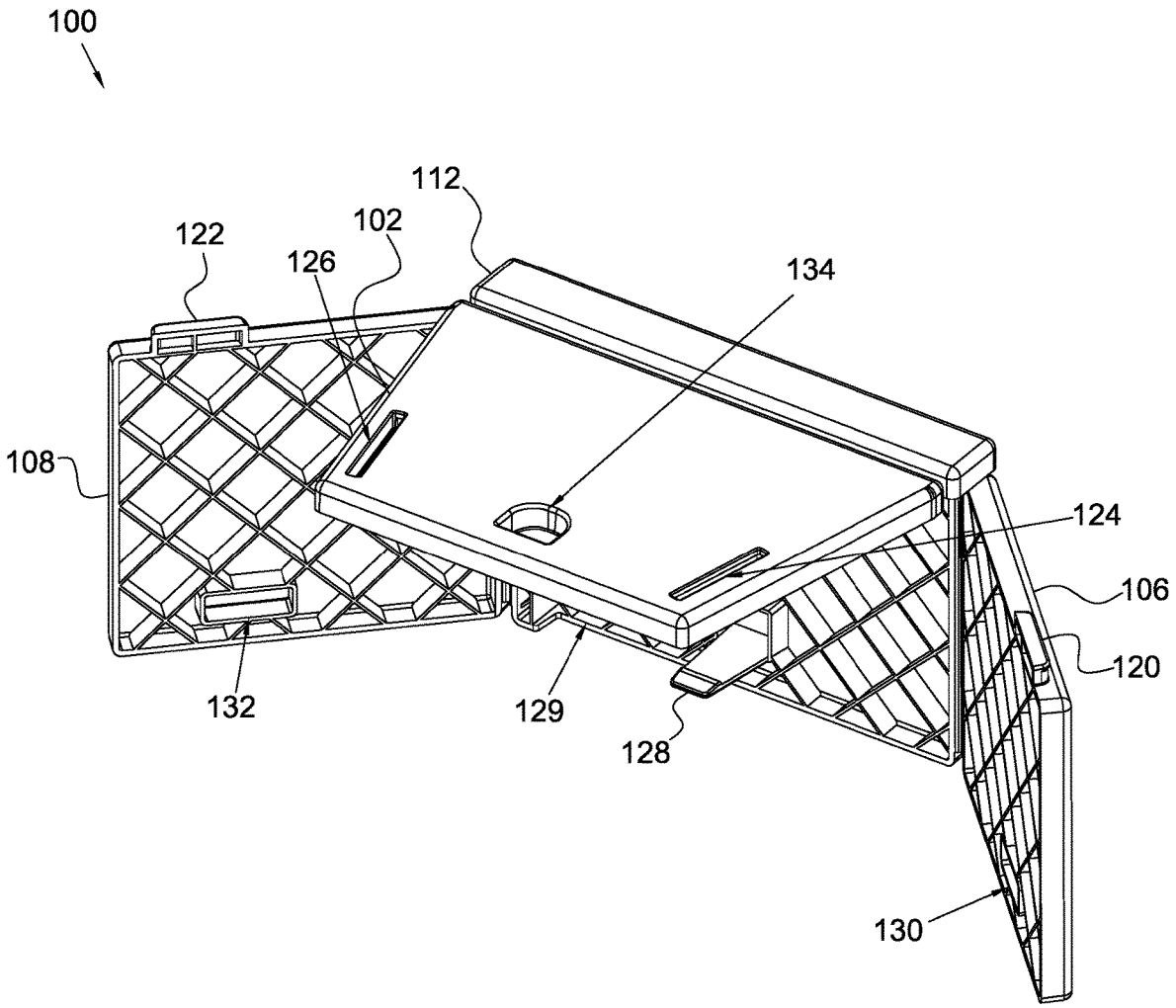
FIG. 14 is an angled view of the collapsible step stool of FIG. 11 in a first phase of assembly.

Again, as shown best in FIGS. 14 and 15, the front riser 104, left riser 106, right riser 108, and top step 102 open away from one another and secure in place via the stoppers 120, 122 and the apertures 124, 126. In embodiments, it is contemplated that all of the components discussed that make up the stool 100 may be integral together and formed such as through injection molding or the like. This allows for ease in manufacturing.

Figure 13:
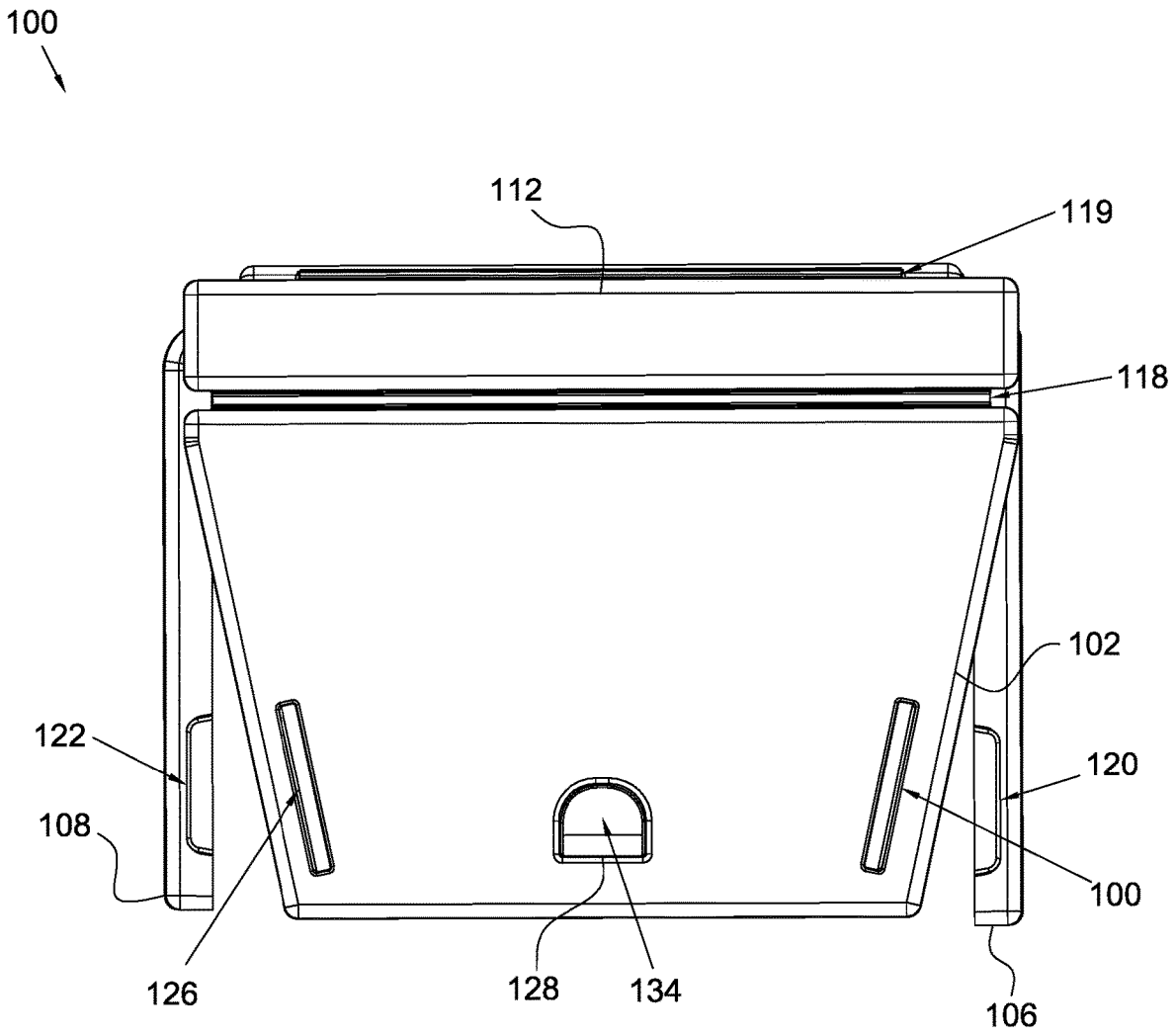
FIG. 13 is a top view of the collapsible step stool of FIG. 11 in a collapsed configuration.

In embodiments, stool 100 further includes a locking system, having a snap lock 128 extending from an interior surface 129 of the front riser 104. The snap lock 128 includes a hook or similar feature, that allows for the snap hook 128 to extend through a first opening 130 extending through the left riser 106, a second opening 132 extending through the right riser 108, and a third opening 134 extending through the top step. Accordingly, as shown in FIG. 13, the snap lock 128 extends through all respective openings when the stool 100 is folded, thereby securing the stool 100 in the collapsed configuration for easy transport.

As discussed, the dimensions of the stool 100 can vary, however, in embodiments, the stool 100 has a length of around 9 inches, a height of around 6 inches, and a width of around 7 inches, as shown with respective arrows A, B, and C in FIG. 15. Further, in embodiments, the risers and top step each have a thickness of approximately 0.5 inches, as shown with arrow T in FIG. 12.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A collapsible step stool, comprising:

a front riser extending from a top end to a bottom end and from a left side to a right side;

a left riser connected to the left side of the front riser such that the left riser is configured to hinge relative to the front riser;

a right riser connected to the right side of the front riser such that the right riser is configured to hinge relative to the front riser;

a top step connected to the top end of the front riser such that the top step is configured to hinge relative to the front riser;

a left riser stopper extending from a top edge of the left riser; and a right riser stopper extending from a top edge of the right riser;

wherein the collapsible step stool is configurable into an assembled configuration and a collapsed configuration;

wherein in the assembled configuration:

the right riser is hinged outward from the front riser such that a first angle between an interior surface of the right riser and an interior surface of the front riser is about 60 degrees;

the left riser is hinged outward from the front riser such that a second angle between an interior surface of the left riser and the interior surface of the front riser is about 60 degrees; and the left riser stopper and the right riser stopper are configured to engage with the top step to maintain the left riser and the right riser in a position relative to the top step;

wherein the front riser, left riser, right riser, and top step fold together when the collapsible step stool is in the collapsed configuration; and wherein in the assembled configuration the collapsible step stool is configured to hold a person on the top step due in part to structural stability as created by the first and second angles being about 60 degrees.

2. The collapsible step stool of claim 1, wherein the left riser stopper is a first post extending from a top edge of the left riser and the right riser stopper is a second post extending from a top edge of the right riser, the first post and the second post engage with an outer edge of the top step.

3. The collapsible step stool of claim 1, wherein;

the left riser is connected to the front riser via a first living hinge;

the right riser is connected to the front riser via a right flange such that the right flange extends from an interior surface of the front riser and connects with the right riser via a second living hinge, thereby positioning the second living hinge offset from the first living hinge; and the top step is connected to the front riser via a top flange such that the top flange is connected to the top step via a third living hinge and extends from the top edge of the front riser, the top step connected to the top flange via a fourth living hinge;

wherein, when in the collapsed configuration, the left riser is folded against the front riser, the right riser is folded against the left riser, the top step is folded against the right riser, and the left riser, right riser, and front riser are aligned in a parallel configuration, the top flange being perpendicular to the to step.

4. The collapsible step stool of claim 3, wherein the front riser, the left riser, the right riser, the top step, the left riser stopper, the right riser stopper, the first living hinge, the second living hinge, the right flange, the top flange, and the third living hinge are all integral components and created through injection molding.

5. The collapsible step stool of claim 1, wherein the left riser stopper is a first elongated tab protruding from the top edge of the left riser and the right riser stopper is a second elongated tab protruding from the top edge of the right riser, the first elongated tab extends fully through a first aperture of the top step and the second elongated tab extends fully through a second aperture of the top step when the collapsible step stool is in the assembled configuration, the first aperture and the second aperture extending from a top surface of the step stool through to a bottom surface of the step stool.

6. The collapsible step stool of claim 1, further comprising:

a locking system having:

a snap lock extending from the interior surface of the front riser;

a first opening extending through the left riser, the first opening being fully surrounded by a first side wall as part of the left riser;

a second opening extending through the right riser, the second opening being fully surrounded by a second side wall as part of the right riser; and a third opening extending through the top step;

wherein the snap lock protrudes through the first opening, the second opening, and the third opening and creates a tension hold on the top step such that the left riser, right riser, and top step are all locked to the front riser when in the collapsed configuration.

7. The collapsible step stool of claim 1, further comprising a non-slip surface on the top step.

8. The collapsible step stool of claim 1, wherein:

the front riser, the right riser, and the left riser are rectangular in shape; and the top step is non-rectangular in shape.

9. The collapsible step stool of claim 1, wherein the assembled configuration has a height of around 6 inches, a length of around 9 inches, and a width of around 7 inches.

10. The collapsible step stool of claim 1, wherein the front riser, the left riser, the right riser, and the top step each have a thickness of approximately 0.5 inches.

11. The collapsible step stool of claim 8, wherein the top step is a trapezoid shape.

* * * * *